US009708800B2

(12) United States Patent
Bosio

(10) Patent No.: US 9,708,800 B2
(45) Date of Patent: Jul. 18, 2017

(54) KITCHEN SINK SPRAYER

(75) Inventor: Orlando Bosio, Casaloldo (IT)

(73) Assignee: Orlando Bosio, Casaloldo (IT)

( * ) Notice: Subject to any disclaimer, the term of this patent is extended or adjusted under 35 U.S.C. 154(b) by 55 days.

(21) Appl. No.: 13/316,990

(22) Filed: Dec. 12, 2011

(65) Prior Publication Data

US 2012/0153050 A1 Jun. 21, 2012

(30) Foreign Application Priority Data

Dec. 15, 2010 (IT) ..... MI2010A2289

(51) Int. Cl.

| | |
|---|---|
| ***B05B 7/02*** | (2006.01) |
| ***E03C 1/04*** | (2006.01) |
| *B05B 1/16* | (2006.01) |
| *B05B 1/18* | (2006.01) |
| *B05B 1/30* | (2006.01) |

(52) U.S. Cl.

CPC ..... *E03C 1/0404* (2013.01); *B05B 1/1618* (2013.01); *B05B 1/18* (2013.01); *B05B 1/3013* (2013.01)

(58) Field of Classification Search

CPC ... E03C 1/0404; B05B 1/1618; B05B 1/3013; B05B 1/18

USPC ..... 239/449, 436–448; 137/801

See application file for complete search history.

(56) References Cited

U.S. PATENT DOCUMENTS 4,204,646 A * 5/1980 Shames ..... B05B 1/1609 239/381
7,070,125 B2 * 7/2006 Williams et al. ..... 239/443
7,328,858 B2 * 2/2008 Bosio ..... 239/444
7,467,874 B2 * 12/2008 Gautschi et al. ..... 362/96
2003/0173423 A1 * 9/2003 Haenlein ..... B05B 1/042 239/526
2004/0088786 A1 * 5/2004 Malek ..... B05B 1/1618 4/677
2004/0112985 A1 * 6/2004 Malek ..... B05B 1/1618 239/445

(Continued)

FOREIGN PATENT DOCUMENTS

| | | | |
|---|---|---|---|
| CH | 621494 A5 * | 2/1981 | ..... B05B 1/12 |
| EP | 1418008 | 5/2004 | |
| GB | 2461139 | 12/2009 | |

OTHER PUBLICATIONS

Search Report for Italian Application No. MI2010A002289 filed Dec. 15, 2010.

*Primary Examiner* — Arthur O Hall
*Assistant Examiner* — Joel Zhou
(74) *Attorney, Agent, or Firm* — Pearl Cohen Zedek Latzer Baratz LLP

(57) ABSTRACT

Kitchen sink sprayer, comprising a body provided at one end with a coupling to a flexible hose extending from a faucet for adjusting the flow-rate and connected at its other end to a water outflow plug having an axis inclined with respect to the water flow direction. The body comprises a rod that has at one end a tip adapted to open selectively the access of the water to at least one duct for forming a central jet and to at least one duct for forming a peripheral jet, and has means for actuation by the user. The means for actuation of the rod comprise a tab connected directly to the rod and protruding from the body's enclosure to an extent that is sufficient for contact gripping by the user, in a position located in proximity to the end for entry of the water into the sprayer.

10 Claims, 3 Drawing Sheets

(56) References Cited

U.S. PATENT DOCUMENTS

| | | | | |
|---|---|---|---|---|
| 2005/0189438 | A1* | 9/2005 | Bosio | B05B 1/1618 239/443 |
| 2008/0067264 | A1* | 3/2008 | Erickson | B05B 1/1618 239/445 |
| 2008/0105764 | A1* | 5/2008 | Jianglin et al. | 239/526 |
| 2009/0200400 | A1* | 8/2009 | Lin | 239/391 |
| 2010/0193610 | A1* | 8/2010 | Leber et al. | 239/443 |

* cited by examiner

KITCHEN SINK SPRAYER

BACKGROUND OF THE INVENTION

This application claims priority from Italian Patent Application No. MI2010A002289, filed Dec. 15, 2010, the disclosures of which are incorporated herein by reference.

BACKGROUND OF THE INVENTION

It is known that many faucets installed on kitchen sinks for supplying water and adjusting the flow thereof between open and closed end positions are provided with a flexible hose, accommodated in an adapted duct, that extends at one end from the faucet proper and is provided at the other end with an element called sprayer which is designed to be gripped by the user in order to achieve two purposes.

First of all the sprayer can be manipulated to bring the flow of water to gush at different points in the sink, and also the sprayer can be set, by way of simple actuation of means with which it is provided, to produce the outflow of water in the form of a central jet or a peripheral jet.

In particular there are sprayers, known as "pull-out" in the field, that comprise a body for conveying the water longitudinally, enclosed in an outer enclosure for gripping by a user.

Such body is provided at one end with a coaxial coupling to the flexible water supply hose that extends from the faucet installed on the sink, accommodated in a duct that leads to the exterior with a section that is substantially horizontal or inclined upwardly, while at the other end the body is connected with a water outflow plug which is located at the side wall of the outer enclosure and has an axis which is inclined with respect to the longitudinal axis of the body.

Inside such body a rod is comprised that has at one end a tip which is adapted to open selectively the access of the water to ducts for forming the central jet and to ducts for forming the peripheral jet, and is provided with actuation means that usually make it possible for the user to move it from one to the other of the two selection positions and vice versa.

The means for actuation of the rod which are present in the known art all suffer a certain complexity of construction and consequently are rather cumbersome, and moreover they do not offer the user the best conditions for wielding the sprayer.

In fact they are located at the water outflow end or in proximity thereto, and thus the user is forced to grip the sprayer in such a way that he/she is required to twist it around in order to be able to wield it advantageously.

SUMMARY OF THE INVENTION

The aim of the present invention is to provide a sprayer of the "pull-out" type in which the encumbrance of the means for actuation of the rod is reduced to the minimum, so as to enable a miniaturization of the sprayer taken to the maximum extreme, and which moreover is such as to allow the maximum convenience of handling by the user.

This aim is achieved by an improved kitchen sink sprayer, according to the invention, characterized in that it comprises the features disclosed in the appended claims.

BRIEF DESCRIPTION OF THE DRAWINGS

Further characteristics and advantages of the invention will become better apparent from the detailed description of a preferred, but not exclusive, embodiment of the invention, illustrated by way of non-limiting example in the accompanying drawings, wherein.

DESCRIPTION OF THE PREFERRED EMBODIMENTS

Figure 1:
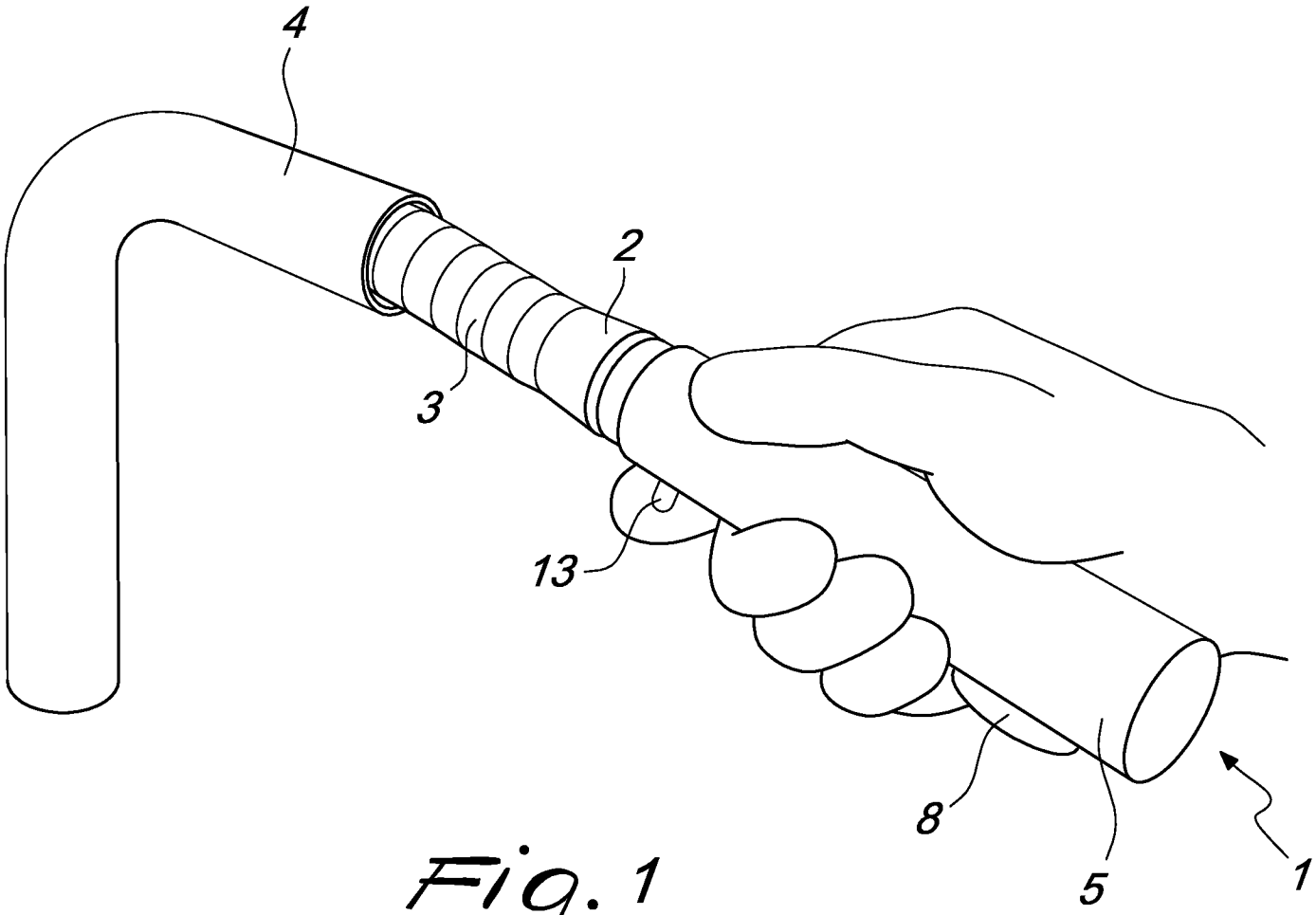
FIG. 1 is a perspective view of the sprayer connected to one end of the flexible hose accommodated in the adapted duct extending from a faucet (not visible in the figure), in a situation of being used by a user.

With reference to the figures, the reference numeral 1 generally designates the sprayer connected by means of the coupling 2 to one end of the flexible hose 3 which is accommodated in the adapted duct 4 and extends at the other end from a faucet, not visible in the figures, that controls the flow-rate of water between the two end positions of completely open and closed.

The sprayer 1 comprises the outer enclosure 5 for gripping by the user, as shown in FIG. 1, inside which a composite body is provided that in turn comprises three main elements, and specifically: a first element 6 on the water inlet side, provided with a threading 6*a* mated with a coupling 2, and fixed to an outer enclosure 5 by means of a threaded grub screw 5*a*, a second element 7 associated with a plug 8 that keeps it in position inside the outer enclosure 5 and comprises a duct 9 provided with an aerator 9*a* for providing the outflow of the water in the form of a central jet and ducts such as 10*a*, 10*b* for forming a peripheral jet, and finally a central element 11.

Advantageously, the presence of the central element 11 means that all the elements can be provided with shapes that are particularly simple and easy to make, and such as to ensure high-performing functional characteristics at the same time.

In the "pull-out" sprayer shown in the figures, the axis of the plug 8 has an angle of inclination with respect to the longitudinal axis of the sprayer of 90°, but inclinations of between 60° and 120° are usual.

Figure 2:
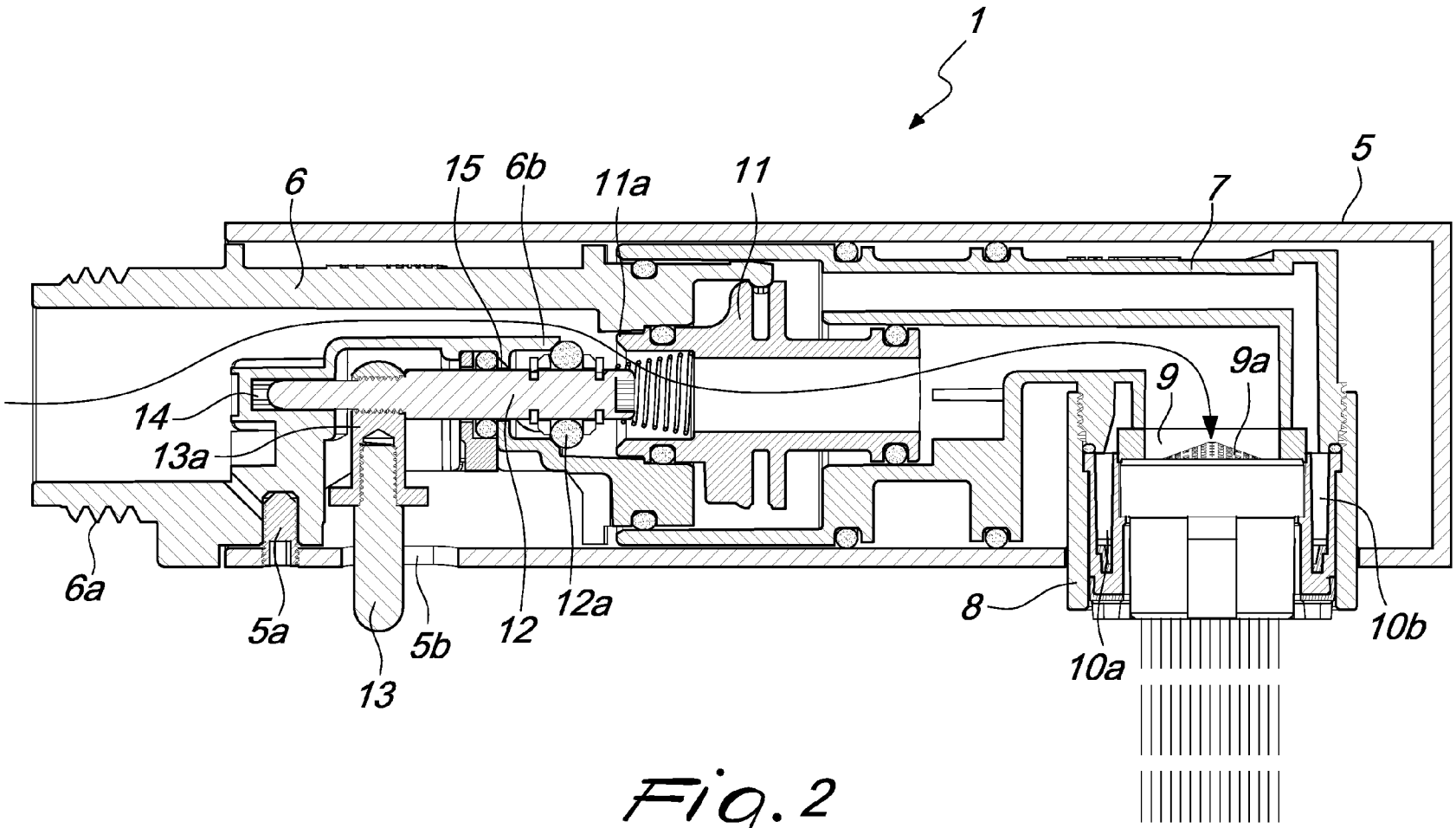
FIGS. 2 and 3 are sectional views of the sprayer respectively in the central jet configuration and in the peripheral jet configuration.
Figure 3:
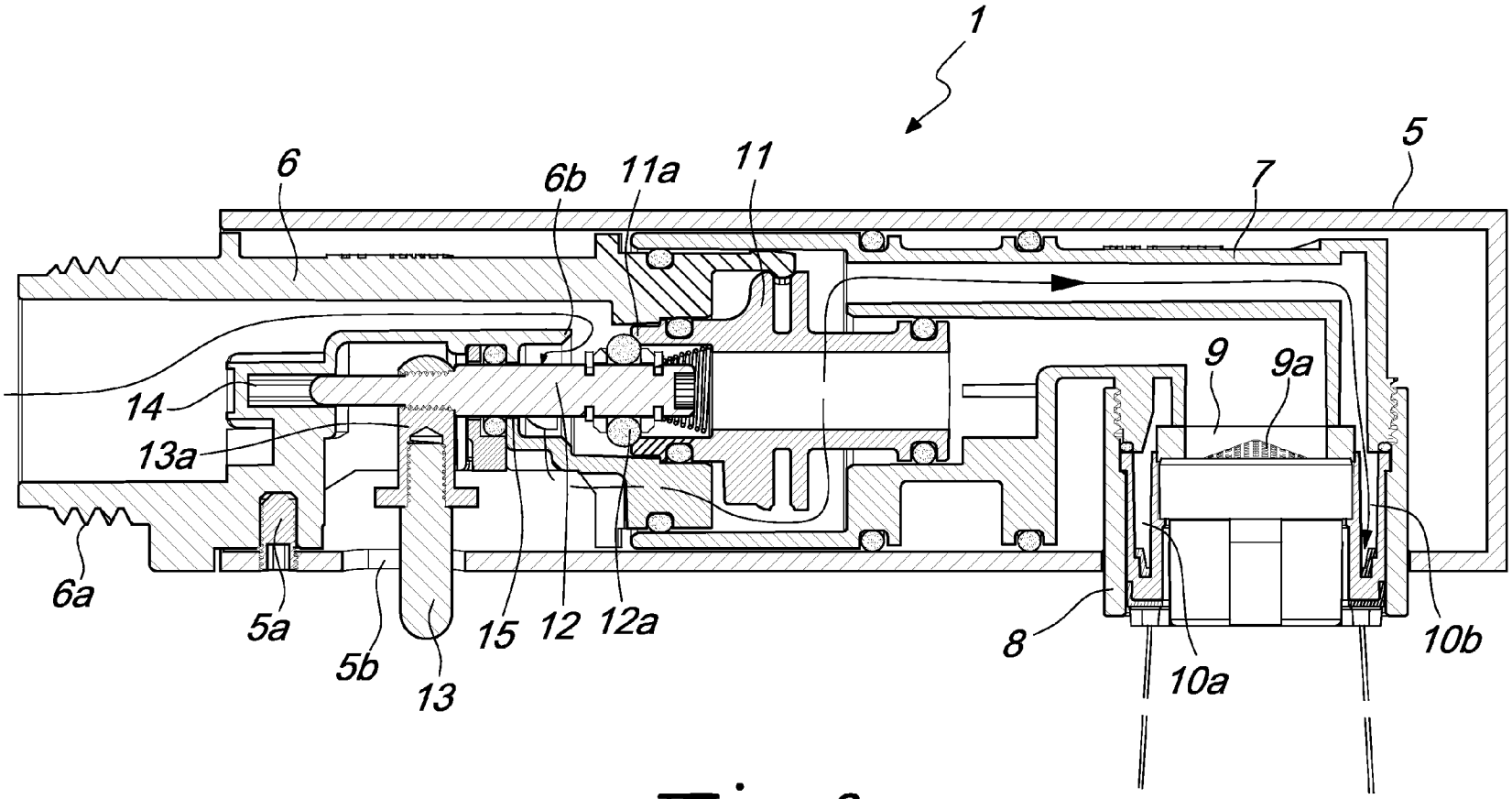

The reference numeral 12 designates a rod which has the tip provided with a gasket 12*a* and adapted to assume, following actuation applied by the operator on the rod 12, the two positions shown respectively in FIG. 2, with a gasket 12*a* in contact with a seal seat 6*b* formed in the element 6, and in FIG. 3, with the gasket 12*a* in contact with a seal seat 11*a* defined in the element 11, so as to open selectively the access of the water, indicated by arrows in the figures, to the duct 9 in order to provide the central jet, which is shown in FIG. 2, and to the ducts 10*a*, 10*b* in order to provide the peripheral jet, which is shown in FIG. 3.

The means for actuation of the rod 12 comprise a tab 13 connected thereto by means of a threaded bushing 13*a* and protruding from the outer enclosure 5 at a slot 5*b* to an extent that is sufficient for contact gripping by the user, in a position that is located very close to the end for entry of the water into the sprayer.

It should be noted that the slot that allows the tab 13 to protrude from the enclosure 5 can be arranged in any position along the circumference of the enclosure.

The rod 12 is guided in its movements by guiding means, constituted by a seat 14 that accommodates the end of the rod proper and by the walls of a hole 15, which are arranged on opposite sides with respect to the coupling position of the tab 13, so as to offer maximum effectiveness.

From the foregoing description it is evident that the means for actuating the rod 12 are exceptionally simple; it is therefore possible to achieve a reduction in encumbrance of the sprayer to levels which could not be possible when adopting means of the type offered by the known art, and merely as an example, the adoption of the means according to the invention has made it possible to make a cylindrical "pull-out" sprayer with a diameter of 28 mm.

Also, the particular positioning of the tab 13 located very close to the entry of the water into the sprayer creates the best conditions for wielding it by the user, as made evident by the deployment of the hand shown in FIG. 1 which shows how, once the sprayer is gripped in a natural manner, by having a finger in contact with the tab 13, the user can work with the sprayer immediately without having to resort to any convolutions.

The invention described is susceptible of numerous modifications and variations, all of which are within the scope of the appended claims. The tab 13 can for example be made integral with the rod 12 in any manner, and moreover nothing changes if the sprayer comprises, in a known manner, a spring that automatically returns it to the central jet position from the peripheral jet position when the faucet is closed.

What is claimed is:

1. A kitchen sink pull-out sprayer, of the type extending from a substantially horizontal section of a faucet duct, comprising:

a body enclosed in an outer enclosure for gripping by a user, a coaxial coupling provided at a first end of the body and configured to couple said body to a flexible water supply hose which extends from a faucet for adjusting the flow-rate between an open position and a closed position, and a water outflow plug connected at a second end of the body, which is located at a side wall of the outer enclosure and has an axis which is inclined with respect to a longitudinal axis of the body representing a direction of the flow of the water in said body, said body comprising internally a rod having a tip, the rod being movable between a first position and a second position in which the tip respectively opens the access of the water to at least one duct for forming a central jet or to at least one duct for forming a peripheral jet, and having an actuating element, said actuating element comprising a tab connected to said rod and configured to drive said rod between said first and second positions, said tab protruding from said outer enclosure of the sprayer to an extent that is sufficient for contact gripping by the user, said tab located proximate to the end for entry of the water into said sprayer said tab location being closer to said sprayer end than to the water outflow plug, and a central portion provided on said outer enclosure between the water outflow plug and the protruding tab, and configured to accommodate a hand of the user;

wherein said body comprises a single rod having a longitudinal axis which is parallel to said longitudinal axis of the body, wherein said single rod alternatively opens the access of the water to the at least one duct for forming a central jet or opens the access of the water to the at least one duct for forming a peripheral jet, said rod being slidingly guided in said body in a sliding direction corresponding to said longitudinal axis of said rod and being movable between a first position and a second position, wherein said tab is movably guided exclusively in a single sliding direction that is parallel to said longitudinal axis of said rod;

wherein in the first position, a tip of said rod blocks access to the at least one duct for forming a peripheral jet, and opens access to the at least one duct for forming the central jet such that a central jet is obtained; and wherein in the second position the tip of said rod blocks access to the at least one duct for forming the central jet, and opens access to the at least one duct for forming the peripheral jet such that a peripheral jet is obtained;

wherein the body enclosed in said outer enclosure has a composite shape, which comprises at least three sleeve-like elements:

a first element on the water side, interiorly defining a first duct portion;

a second element associated with said water outflow plug, interiorly defining a main duct; and a third element located in a position which is intermediate with respect to the first and second elements, said third element interiorly defining an intermediate duct portion that connects the first duct portion and the main duct;

wherein the first element and third element, respectively, define two sealing seats designed to make contact with the tip of said rod in the first position and in the second position, respectively.

2. The sprayer according to claim 1, further comprising a guide for guiding said rod in its motion which is arranged on opposite sides with respect to the coupling position of said tab on said rod.

3. The sprayer according to claim 1, wherein said tab of said rod is connected to said rod by means of threading.

4. The sprayer according to claim 1, wherein said tab of said rod protrudes from said outer enclosure of the sprayer at a slot provided in said enclosure.

5. The sprayer according to claim 1, wherein the first and third elements comprise respectively sealing seats designed to make contact selectively with a gasket that is present on the tip of said rod.

6. The sprayer according to claim 1, wherein said tab is solidly attached to said rod.

7. The sprayer according to claim 1, wherein said tab is connected to said rod in such a manner that the user, by gripping said tab, is able to drive said rod in both directions, from the first to the second position and vice versa.

8. A kitchen sink pull-out sprayer, of the type extending from a substantially horizontal section of a faucet duct, comprising:

a body enclosed in an outer enclosure for gripping by a user, a coaxial coupling provided at a first end of the body and configured to couple said body to a flexible water supply hose which extends from a faucet for adjusting the flow-rate between an open position and a closed position, and a water outflow plug connected at a second end of the body, which is located at a side wall of the outer enclosure and has an axis which is inclined with respect to a longitudinal axis of the body representing a direction of the flow of the water in said body, said body comprising internally a rod having a tip, the rod being movable between a first position and a second position in which the tip respectively opens the access of the water to at least one duct for forming a central jet or to at least one duct for forming a peripheral jet, and having an actuating element, said actuating element comprising a tab connected to said rod and configured to drive said rod between said first and second positions, said tab protruding from said outer enclosure of the sprayer to an extent that is sufficient for contact gripping by the user, said tab located proximate to the end for entry of the water into said sprayer said tab location being closer to said sprayer end than to the water outflow plug, and a central portion provided on said outer enclosure between the water outflow plug and the protruding tab, and configured to accommodate a hand of the user;

wherein said body comprises a single rod having a longitudinal axis which is parallel to said longitudinal axis of the body, wherein said single rod alternatively opens the access of the water to the at least one duct for forming a central jet or opens the access of the water to the at least one duct for forming a peripheral jet, said rod being slidingly guided in said body in a sliding direction corresponding to said longitudinal axis of said rod and being movable between a first position and a second position;

wherein in the first position, a tip of said rod blocks access to the at least one duct for forming a peripheral jet, and opens access to the at least one duct for forming the central jet such that a central jet is obtained; and wherein in the second position the tip of said rod blocks access to the at least one duct for forming the central jet, and opens access to the at least one duct for forming the peripheral jet such that a peripheral jet is obtained;

wherein the body enclosed in said outer enclosure has a composite shape, which comprises at least three sleeve-like elements:

a first element on the water side, interiorly defining a first duct portion;

a second element associated with said water outflow plug, interiorly defining a main duct, wherein said second element is elbow-shaped; and a third element located in a position which is intermediate with respect to the first and second elements, said third element interiorly defining an intermediate duct portion that connects the first duct portion and the main duct;

wherein the first element and third element, respectively, define two sealing seats designed to make contact with the tip of said rod in the first position and in the second position, respectively, and wherein a longitudinal portion of the main duct is aligned with the longitudinal axis, and wherein an inclined portion of the main duct is inclined with respect to said longitudinal axis.

9. The sprayer according to claim 8, wherein:

said second element interiorly defines a secondary duct which is separate from said main duct, the at least one duct for forming a central jet comprises said main duct, and the at least one duct for forming a peripheral jet comprises said secondary duct.

10. A kitchen sink pull-out sprayer, comprising:

a body enclosed in an outer enclosure for gripping by a user, a coaxial coupling provided at a first end of the body and configured to couple said body to a flexible water supply hose which extends from a faucet for adjusting the flow-rate between an open position and a closed position, and a water outflow plug connected at a second end of the body, which is located at a side wall of the outer enclosure and has an axis which is inclined with respect to a longitudinal axis of the body representing a direction of the flow of the water in said body, said body comprising internally a rod having a tip, the rod being movable between a first position and a second position in which the tip respectively opens the access of the water to at least one duct for forming a central jet or to at least one duct for forming a peripheral jet, and having an actuating element, said actuating element comprising a tab connected to said rod and configured to drive said rod between said first and second positions, said tab protruding from said outer enclosure of the sprayer to an extent that is sufficient for contact gripping by the user, said tab located proximate to the end for entry of the water into said sprayer said tab location being closer to said sprayer end than to the water outflow plug, and a central portion provided on said outer enclosure between the water outflow plug and the protruding tab, and configured to accommodate a hand of the user;

wherein said body comprises a single rod having a longitudinal axis which is parallel to said longitudinal axis of the body, wherein said single rod alternatively opens the access of the water to the at least one duct for forming a central jet or opens the access of the water to the at least one duct for forming a peripheral jet, said rod being slidingly guided in said body in a sliding direction corresponding to said longitudinal axis of said rod and being movable between a first position and a second position, wherein said tab is movably guided exclusively in a single sliding direction that is parallel to said longitudinal axis of said rod;

wherein in the first position, a tip of said rod blocks access to the at least one duct for forming a peripheral jet, and opens access to the at least one duct for forming the central jet such that a central jet is obtained; and wherein in the second position the tip of said rod blocks access to the at least one duct for forming the central jet, and opens access to the at least one duct for forming the peripheral jet such that a peripheral jet is obtained;

wherein the body enclosed in said outer enclosure has a composite shape, which comprises at least three sleeve-like elements:

a first element on the water side, interiorly defining a first duct portion;

a second element associated with said water outflow plug, interiorly defining a main duct, wherein said second element is elbow-shaped; and a third element located in a position which is intermediate with respect to the first and second elements, said third element interiorly defining an intermediate duct portion that connects the first duct portion and the main duct;

wherein the first element and third element, respectively, define two sealing seats designed to make contact with the tip of said rod in the first position and in the second position, respectively.

* * * * *